US005245143A

United States Patent [19]

James et al.

[11] Patent Number: 5,245,143

[45] Date of Patent: Sep. 14, 1993

[54] ELECTROMECHANICAL SWITCH ACTUATOR

[75] Inventors: Benjamin B. James, Birchrunville; Edward J. Clark, Havertown, both of Pa.

[73] Assignee: Westcode Incorporated, Malvern, Pa.

[21] Appl. No.: 685,279

[22] Filed: Apr. 9, 1991

[51] Int. Cl.[5] ..... H01H 27/06; E05B 19/02

[52] U.S. Cl. ..... 200/43.08; 200/43.04; 200/564; 200/336; 70/404; 70/346

[58] Field of Search ..... 200/43.04, 43.01, 43.08, 200/564, 329, 336, 61.64; 70/345, 346, 404, DIG. 15

[56] References Cited

U.S. PATENT DOCUMENTS

| | | | |
|---|---|---|---|
| 1,363,599 | 12/1920 | Hull | 70/404 |
| 1,434,031 | 10/1922 | Wallace | 200/43.08 |
| 1,700,799 | 2/1929 | Inglis et al. | 70/404 |
| 2,279,623 | 4/1942 | Jacobi | 200/43.08 |
| 3,095,725 | 7/1963 | Unswarth | 70/346 |
| 4,147,905 | 4/1979 | Scherbirg | 200/43.08 |
| 4,611,104 | 9/1986 | Reddy | 200/43.08 |
| 4,633,689 | 1/1987 | Wolniak et al. | 200/43.08 |
| 4,870,842 | 10/1989 | Plumer | 70/346 |
| 5,055,643 | 10/1991 | Pardini et al. | 200/43.08 |

*Primary Examiner*—Henry J. Recla
*Assistant Examiner*—Keith Kupferschmid
*Attorney, Agent, or Firm*—Seidel, Gonda, Lavorgna & Monaco

[57] ABSTRACT

An electromechanical rotary switch actuator for the operation of doors of mass transit vehicles. The switch actuator discloses a crew switch actuator that incorporates the features of a rotary switch while at the same time provides low cost manufacturing of the switch actuator apparatus. The invention is a simple, yet innovative, apparatus whereby rotational control of the switch assembly is provided by a retaining member which mates with a slot grooved into a shaft mounted for rotation in the actuator body. The longitudinally axial dimension of the actuator body is small which enables the apparatus to be flush mounted to the outside walls of the transit vehicles. The crew switch actuator disclosed is operated not only by a detachable key which is also disclosed, but also may be actuated with the same keys currently being used to operate the door control switches of most mass transit systems.

13 Claims, 2 Drawing Sheets

10

ELECTROMECHANICAL SWITCH ACTUATOR

The present invention relates generally to electromechanical key switch actuators and, in particular, relates to electromechanical key switch actuators for use as crew switches in the control of doors on mass transit vehicles.

BACKGROUND OF THE INVENTION

On a typical mass transit vehicle there are a number of electromechanical switches for operation by the crew of the vehicle in order to control the operation of the doors. Such electromechanical switch actuators are key switch actuated. In other words, when a key is inserted into the switch actuator, the crew of the vehicle may operate an electromechanical switch that is used to control the operation of the doors. Without access to the key, the switches that control the doors are inoperable. Thus, an unauthorized person, who does not have a key, cannot open or close the doors and create an unsafe condition for the riding public.

One type of electromechanical switch that may be present on such a vehicle is known as a "crew switch." A crew switch is a switch that controls the opening and closing of a single door on a single vehicle in order to permit access to the vehicle by the crew and by maintenance personnel. Typically, one crew switch is found on the outside of each transit car and two other crew switches are found on the inside of each car in the passenger compartment, one to control the doors on the left side of the car and, another, to control the doors on the right side of the car.

Another type of electromechanical switch that may be present on a mass transit vehicle is a "door control switch." A door control switch is located in the cab of the transit vehicle, rather than in the passenger compartment. When a key is inserted into the door control switch actuator by the motorman in the cab and activated, the motorman is able to control the opening of the doors in the passenger compartment throughout the train during regular service.

Typically, crew switches have been cam-operated limit switches. Door control switches, on the other hand, have been rotary switches. One type of electromechanical key switch actuator for use as a door control switch and that is known in the prior art is set forth in U.S. Pat. No. 4,611,104-Reddy. The Reddy patent discloses an electromechanical key switch actuator for use in controlling a rotary switch for door control. The actuator of the Reddy patent is straddle mounted on the wall of the cab of the mass transit vehicle. In other words, the actuator is situated on the inside of the cab of the vehicle and the rotary switch to which the actuator is coupled is situated on the inside of the electrical control box on the opposite side of the cab wall. The Reddy actuator also includes a forwardly projecting boss projecting forward of an indicator face. A shaft is situated within the boss. A key is inserted into the boss and is designed to mate with the shaft. The key includes an insert end that includes a cavity therein. The cavity mates with the shaft within the boss. The configuration of the key and boss are such as to permit entry and withdrawal of the key at certain preselected angular positions but to preclude entry and withdrawal of the key at other angular positions.

It would be desireable to provide a key switch actuator for use as a crew switch that employed the same key used to operate the door control switch so that the crew of the mass transit vehicle need carry only a single key. However, certain features of the switch actuator of the Reddy patent make that actuator unsuitable for use as crew switch. First, the actuator of the Reddy patent is straddle mounted. While straddle mounting is tolerable in the cab of the transit vehicle, as in the case of a door control switch, that type of mounting is unsuitable in the passenger compartment because there is insufficient axial clearance for a straddle mounted actuator. In addition, the axial dimension of the switch actuator of the Reddy patent is such that it is unsuitable for use as a crew switch actuator. Because a crew switch, unlike the door control switch of a mass transit vehicle, is located in the passenger compartment, rather than in the cab, it is important that the actuator be flush with the vehicle wall.

Another problem associated with the actuator of the Reddy patent is the fact that the central shaft is part of a switch stop plate. The switch stop plate includes a radially projecting stop mechanism and an indicator face. The stop mechanism precludes over-rotation of the switch. The indicator face provides a visual indication of the switch position when the key is removed from the device. Because of the radial projection of the switch stop plate, however, it is necessary that the switch stop plate and the forward shaft projecting from it be manufactured by a metal casting process. Such a procedure is costly and causes the Reddy actuator to be unduly expensive.

A need has arisen for a rotary crew switch actuator that is more reliable than the cam activated crew switches of the prior art. A need has also arisen for a rotary crew switch actuator that can be flush mounted on the vehicle wall.

It is also important that any crew switch actuator be manufactured simply and at a low cost and yet include a provision to preclude over-rotation of the switch.

Finally, a need has arisen for a crew switch actuator that is not only key actuated but also that may be actuated with the same keys that are used for door control, such as the keys that are currently used to actuate door control switches in the manner of the Reddy patent.

Accordingly, it is the general object of the present invention to develop a low-cost rotary crew switch actuator.

It is a further object of the present invention to provide a rotary crew switch actuator that is key actuated with keys compatible with door control switch actuators of the type generally set forth in the Reddy patent.

It is still a further object of the present invention to provide a rotary crew switch actuator that has a small axial dimension.

It is still a further object of the present invention to provide a rotary crew switch actuator that is flush mounted, as opposed to straddle mounted, to the wall of a mass transit vehicle.

It is still a further object of the present invention to provide a crew switch actuator that may be manufactured simply and economically without the need for a metal casting process and yet which includes a means to preclude over-rotation of the switch.

These objects are met by the improved electromechanical switch actuator of the present invention.

SUMMARY OF THE INVENTION

Briefly, the present invention is directed to an electromechanical key switch actuator for use as a crew switch of a mass transit vehicle. The key switch actuator includes an actuator body having a front surface adapted to be mounted within the vehicle wall and a rear surface adapted to be mounted to a rotary switch also located within said vehicle wall. The actuator body also includes a cylindrical hole extending from the front surface of the actuator body through to the rear surface. It further includes a rearward cavity recessed in the rear surface. The longitudinal axes of the rearward cavity and the cylindrical hole are offset such that only a portion of the cylindrical hole and a portion of said rearward cavity (50) are in overlapping relationship. The key switch actuator also includes a key actuator shaft mounted for rotation in the cylindrical hole. The key actuator shaft has a male portion adapted to mate with a female end of an operating key and a female portion adapted to mate with the rotary switch. The key actuator shaft also includes an intermediate portion having a partially circumferential peripheral slot formed therein. A retaining means is situated in the rearward cavity and is mechanically affixed to the actuator body. The retaining means not only retains the key actuator shaft within the actuator housing and restrains it against axial movement, but also mates with the peripheral slot to preclude rotation of the key actuator shaft beyond a predetermined angular position. A face plate is mounted to the front surface of the actuator body which includes a central opening overlying the cylindrical hole. The female end of an operating key entering the hole can be inserted and removed therefrom only in predetermined positions.

The present invention provides a rotary crew switch actuator that has a small axial dimension. The switch actuator may be mounted flush with the wall of the vehicle. The actuator precludes the transmission of undue axial and radial forces to the switch that have the tendency to cause failure of the switch and, yet, the actuator is inexpensive to produce.

BRIEF DESCRIPTION OF THE DRAWINGS

The present invention will be more fully described with reference to the accompanying drawing, in which.

DETAILED DESCRIPTION OF THE PREFERRED EMBODIMENTS

Figure 1:
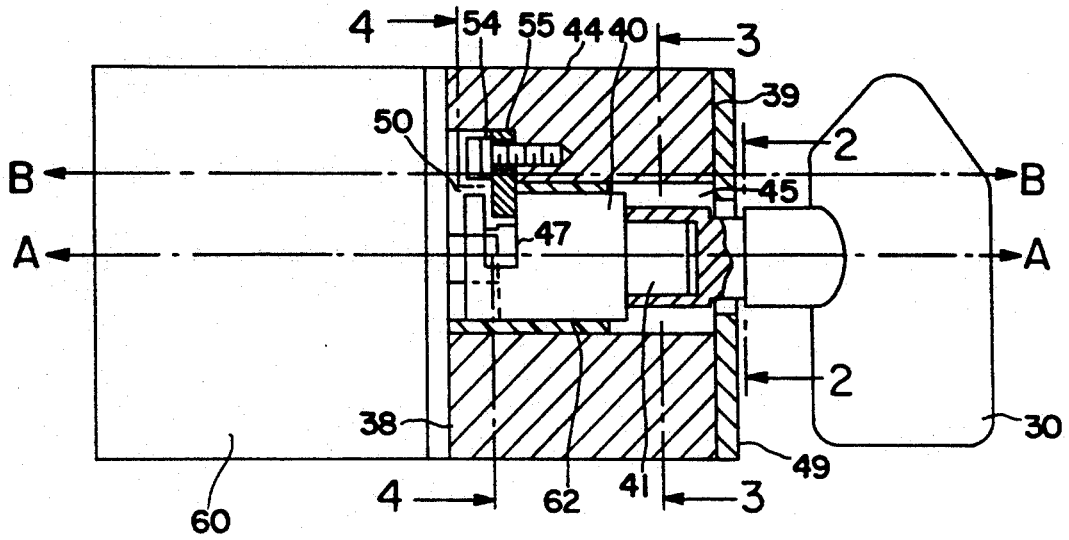
FIG. 1 is a longitudinal cross sectional view of the electromechanical switch actuator of the present invention and of a switch assembly associated therewith and further showing an operating key.
Figure 5:
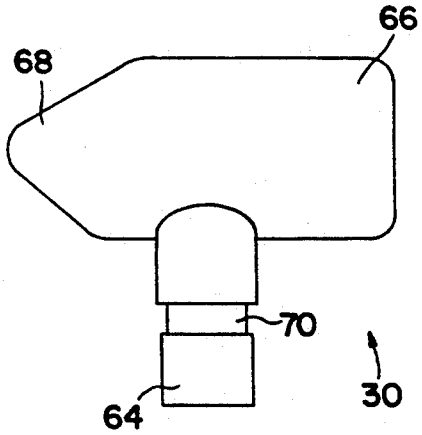
FIG. 5 is a plan view of the operating key.

Referring first to FIG. 1 the present invention will be described in detail. In FIG. 1, an electromechanical key switch actuator is shown generally at 10. The electromechanical key switch actuator 10 is preferably used as a crew switch of a mass transit vehicle in order to control the position of a rotary electromechanical switch assembly shown schematically at 60. The rotary position of the electromechanical switch assembly 60 is determined by the angular position of a removable operating key 30. The details of the operating key 30 are shown in FIG. 5 and will be described further below.

The electromechanical key switch actuator 10 of the present invention includes an actuator body 44. The actuator body 44 preferably comprises a rectangular metal block having a front surface 39 that is adapted to be mounted within the vehicle wall (not shown) and a rear surface 38 that is also located within the vehicle wall.

Figure 3:
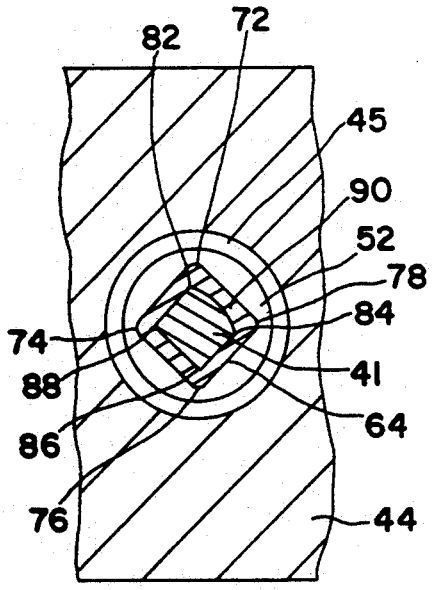
FIG. 3 is a cross sectional view of the electromechanical switch actuator of FIG. 1, taken along section line 3—3.

As may best be seen by reference to FIGS. 1 and 3, the actuator body 44 includes a cylindrical hole 45. The cylindrical hole extends from the front surface 39 of the actuator body 44 and extends through to the rear surface 38 of the actuator body 44.

Figure 4:
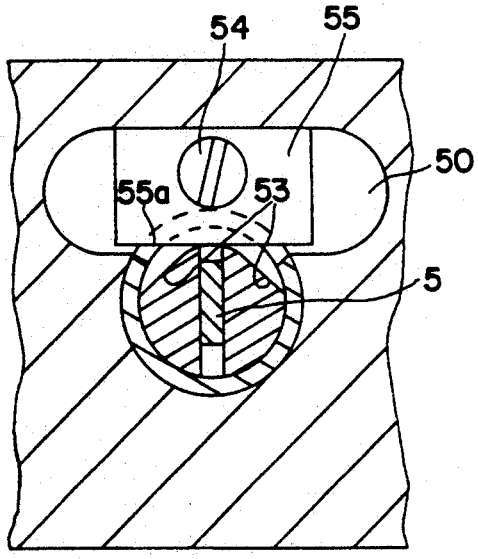
FIG. 4 is a cross sectional view of the electromechanical switch actuator of FIG. 1, taken along section line 4—4.

As may best be seen by reference to FIGS. 1 and 4, the actuator body 44 also includes a rearward cavity 50 recessed in the rear surface 38 of the body 44 itself. The rearward cavity 50 does not extend through to the front surface 39 of the actuator body. The longitudinal axis of the cylindrical hole 45 is shown in FIG. 1 at A—A. The longitudinal axis of the rearward cavity is shown in FIG. 1 at B—B. The longitudinal axis A—A of the cylindrical hole 45 is offset from the longitudinal axis B—B of the rearward cavity 50 such that only a portion of the cylindrical hole 45 and a portion of the rearward cavity 50 overlap to form a combined cavity.

The electromechanical key switch actuator 10 of the present invention further includes a key actuator shaft 40 mounted for rotation in the cylindrical hole 45. As may best be seen with reference to FIGS. 1 and 6, the key actuator shaft 40 includes a male portion 41. The male portion 41 of the key actuator shaft 40 is adapted to mate with the female end of the operating key 30. The key actuator shaft 40 further includes a female portion 43 adapted to mate with the central shaft S of the rotary electromechanical switch 60. In accordance with the preferred embodiment of the present invention the female portion 43 of the key actuator shaft 40 simply includes a slot that mates with a reduced end of the shaft S.

Figure 6:
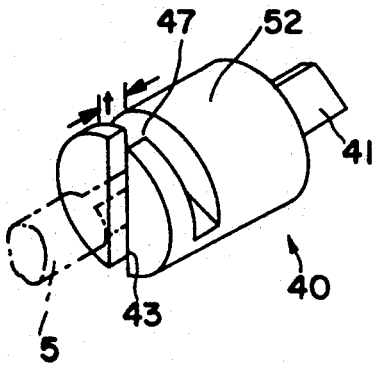
FIG. 6 is a perspective view of the key actuator shaft component removed from the electromechanical switch actuator of FIG. 1.
Figure 2:
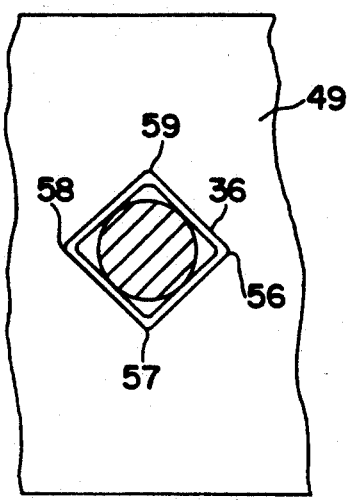
FIG. 2 is a cross sectional view of the electromechanical switch actuator of FIG. 1, taken along section line 2—2.

Referring next to FIG. 6, the key actuator shaft 40 include an intermediate portion 52 that is a generally cylindrical region that rotates within the cylindrical cavity 45. The intermediate portion 52 of the key actuator shaft 40 includes a partially circumferential slot 47 formed therein, the function of which will be more fully described below. As shown in FIG. 4, the partially circumferential slot 47 is preferably of varying depth to provide a camming surface 53. The function of the camming surface 53 will also be more fully described below.

The electromechanical key switch actuator 10 further includes a retaining means 55. The retaining means 55 is situated within the rearward cavity 50 of the actuator body and is mechanically fixed to the actuator body 44 by means, for example, of a screw 54. The retaining means 55 preferably comprises a metal plate having a thickness slightly less than the thickness, "t", of the partially circumferential slot 47 formed in the intermediate portion of the key actuator shaft 40. When assembled as shown in FIG. 1, the retaining means 55 is situated within the slot 47 in the key actuator shaft 40. The retaining means 55 mates with the slot 47 and precludes axial movement of the key actuator shaft 40. Because the key actuator shaft 40 is restrained in the axial direction, undue axial forces are not transmitted from the operating key 30 to the switch 60. In addition, the camming surfaces 53 at the bottom of the slot 47 preclude over-rotation of the actuator key shaft 40 beyond a predetermined angular position. As the key actuator shaft 40 is rotated either clockwise or counter-clockwise, one of the camming surfaces 53 come into contact with the bottom surface 55*a* (FIG. 4) of the retaining means 55. This, likewise prevents the unwanted transmission of excess radial forces from the key 30 to the switch 60 that are known to have the tendency to cause failure in the switch.

In accordance with still another aspect of the present invention the electromechanical key switch actuator 10 includes a face plate 49 that abuts and is mounted to the front surface 39 of the actuator housing 44. The face plate is adapted for flush mounting with the wall of a mass transit vehicle with the actuator 10 of the present invention situated within the vehicle wall. The face plate 49 includes a central opening 36 therein. The central opening 36 overlies the cylindrical hole 45 and provides access by the operating key 30 to the key actuator shaft 40. The central opening 36 has internal corners 56, 57, 58 and 59. As will be more fully described below, the internal corners of the opening 36 correspond with corner-like projections on the outer surface of the insert end of the operating key 30 so that, in predetermined relative orientations of the key 30 and the central opening 36, the insert end can pass the central opening 36. However, in other relative orientations of the key 30 and the central opening 36, the insert end cannot pass the central opening 36 and the key 30 is retained by the face plate 49.

In accordance with the preferred embodiment of the present invention the electromechanical switch actuator 10 includes a bushing 62. The bushing 62 is preferably a plastic member that facilitates rotation of the key actuator shaft 40 within the cylindrical hole 45.

Referring now to FIG. 5, the operating key 30 will be described in further detail. The operating key 30 includes an insert end 64 having a cavity therein for receiving the male portion 41 of the key actuator shaft 40. The operating key 30 also includes a handle end 66 remote from said insert end and preferably having an indicating portion 68 to provide a means of orienting the key. The operating key 30 further includes an intermediate portion 70 joining the insert end 64 and the handle end 66, the intermediate portion 70 including a groove on its outer surface.

As shown in FIG. 3, the insert end 64 of the operating key 30 includes a number of corner-like projections 72, 74, 76 and 78 on its outer surface. The corner-like projections correspond in number with the internal corners 56, 57, 58 and 59 of the central opening 36 on the face plate 49 to insure that the operating key 30 can only be inserted and withdrawn from the face plate 49 in certain predetermined orientations.

Also as shown in FIG. 3, the insert end 64 of the operating key 30 includes a cavity therein for receiving the male portion 41 of the key actuator shaft 40. In the embodiment of FIG. 3 the cavity has four internal corners that correspond in location and number to four peripheral projections 82, 84, 86 and 88 on the outer surface of the male portion 41 of the key actuator shaft 40. The male portion 41 of the key actuator shaft 40 also includes one curved surface 90 that corresponds to a curved surface within the cavity in the insert end 64 of the key 30. In this manner the key 30 can only be mated with the male portion 41 of the key actuator key shaft 40 in one orientation.

Figure 7:
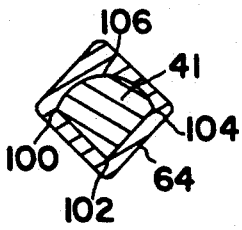
FIG. 7 is a cross sectional view of the male portion of the key actuator shaft and mating female portion of an operating key according to an alternate embodiment of the present invention to that shown in FIG. 3.

As shown in an alternate embodiment of FIG. 7, the insert end 64 of the operating key 30 includes a cavity therein for receiving the male portion 41 of the key actuator shaft 40. In the embodiment of FIG. 7 the cavity has three internal corners 100, 102 and 104 that correspond in location and number to three peripheral projections on the outer surface of the male portion 41 of the key actuator shaft 40. The male portion 41 of the key actuator shaft 40 also includes one curved surface 106 that corresponds to a curved surface within the cavity in the insert end 64 of the key 30. Likewise, in this embodiment, the operating key 30 can only be mated with the male portion 41 of the key actuator shaft 40 in one orientation. The cross-section of the male portion 41 of the key actuator shaft 40 shown in FIG. 7 is the same shape as the inner cavities of the operating keys currently being used by the crew of many mass transit systems as set forth in U.S. Pat. No. 4,611,104 - Reddy.

The present invention prevents over-rotation of the rotary switch with a key stopping mechanism that can be manufactured at very low cost. It will be appreciated that the key actuator shaft 40 can be machined out of bar stock. In contrast, the switch stop plate of the aforementioned Reddy patent is manufactured with an expensive casting process. In addition, the present invention provides for an electromechanical switch actuator that does not include a boss of the type described in the Reddy patent and that may be flush, rather than straddle, mounted to the wall of a mass transit vehicle. The actuator is axially compact. In addition, the switch actuator of the present invention employs an operating key that is compatible with the switch actuator of the Reddy patent such that a motorman need carry but one key. Furthermore, the actuator is rugged and tamperproof.

Although certain embodiments of the present invention have been described above with particularity, these embodiments are exemplary and not meant to limit the scope of the present invention. Numerous variations and departures from the examples set forth above will immediately present themselves to those of ordinary skill. Accordingly, reference should be made to the appended claims in order to ascertain the scope of the present invention.

What is claimed is:

1. An electrochemical key switch actuator for use as a crew switch of mass transit vehicle comprising:

(a) an actuator body adapted to be entirely within a wall of the vehicle and having a substantially planar front surface adapted to be mounted within the vehicle wall;

a rear surface adapted to be mounted to a rotary switch located within said vehicle wall;

a cylindrical hole extending from said front surface of the actuator body through to said rear surface of the body; and a rearward cavity in communication with said hole and recessed in said rear surface of the body, the longitudinal axes of said rearward cavity and said cylindrical hole being offset such that only a portion of said cylindrical hole and a portion of said rearward cavity are in overlapping relationship;

(b) a key actuator shaft mounted for rotation in said cylindrical hole, said key actuator shaft having a male portion having a unique configuration adapted to mate with a correspondingly configured female end of an operating key, a female portion adapted to mate with said rotary switch, and an intermediate portion of substantially constant cross-sectional dimensions having a partially peripheral slot formed therein;

(c) retaining means situated in said rearward cavity and mechanically affixed to said actuator body, said retaining means mating with said peripheral slot to preclude axial movement of said shaft and rotation thereof beyond predetermined angular positions;

(d) a substantially planar face plate mounted to the front surface of said actuator body, said face plate having a central opening overlying said cylindrical hole, such that the female portion of said operating key can be inserted into and mated with the male portion of said key actuator shaft and removed therefrom only in predetermined positions.

2. The electromechanical key switch actuator of claim 1 further comprising:

(e) a bushing situated within said cylindrical hole to facilitate rotation of said key actuator.

3. The electromechanical key switch actuator of claim 1 where said face plate is adapted to be flush mounted to the interior surface of an outer wall of the transit vehicle.

4. The electromechanical key switch actuator of claim 1 wherein said face plate is adapted to be flush mounted to the interior surface of an inner wall of the transit vehicle.

5. The electromechanical key switch actuator of claim 1 wherein said central opening of said face plate is aligned with and overlies said cylindrical hole in said actuator body.

6. The electromechanical key switch actuator of claim 1 wherein the male portion of said key actuator further comprises:

a number of spaced peripheral projections.

7. The electromechanical key switch actuator of claim 6 wherein said male portion of said key actuator includes four spaced peripheral projections.

8. The electromechanical key switch actuator of claim 6 wherein said male portion of said key actuator includes three spaced peripheral projections.

9. The electromechanical key switch actuator of claim 6, said key comprising:

an insert end having a number of corner-like projections on its outer surface;

a cavity in said insert end for receiving said male portion of said key actuator, said last-mentioned cavity having internal corners corresponding in location and number to said male portion peripheral projections but being at least one less in number than the number of outer surface corner-like projections;

a handle end remote from said insert end and having an indicating portion; and an intermediate portion joining said insert end and said handle end, said intermediate portion including a groove on its outer surface.

10. The electromechanical key switch actuator of claim 9 wherein the cavity in the insert end of said operating key has at least four internal corners.

11. The electromechanical key switch actuator of claim 10 wherein the cavity in the insert end of said operating key has three internal corners.

12. The electromechanical key switch actuator of claim 10 wherein the central opening of said face plate has internal corners corresponding in number and location to the corner-like projections on the outer surface of the insert end of said operating key so that in predetermined relative orientations of said insert end and said central opening, said insert end can pass said central opening; and so that in other relative orientations of said insert end and said central opening, said insert end cannot pass said central opening and said key is retained by said face plate.

13. The electromechanical key switch actuator of claim 12 wherein the outer surface of the insert end of said operating key has four corner-like projections.

* * * * *